US009995291B2

(12) United States Patent
Kinjo et al.

(10) Patent No.: US 9,995,291 B2
(45) Date of Patent: Jun. 12, 2018

(54) SEALED COMPRESSOR AND REFRIGERATION UNIT INCLUDING SEALED COMPRESSOR

(71) Applicant: Panasonic Intellectual Property Management Co., Ltd., Osaka-shi, Osaka (JP)

(72) Inventors: Kenji Kinjo, Shiga (JP); Hiromitsu Iwata, Shiga (JP); Akihiko Kubota, Kyoto (JP)

(73) Assignee: PANASONIC APPLIANCES REFRIGERATION DEVICES SINGAPORE, Singapore (SG)

( * ) Notice: Subject to any disclaimer, the term of this patent is extended or adjusted under 35 U.S.C. 154(b) by 257 days.

(21) Appl. No.: 14/410,450

(22) PCT Filed: Jul. 17, 2013

(86) PCT No.: PCT/JP2013/004365
§ 371 (c)(1),
(2) Date: Dec. 22, 2014

(87) PCT Pub. No.: WO2014/017051
PCT Pub. Date: Jan. 30, 2014

(65) Prior Publication Data

US 2015/0345485 A1 Dec. 3, 2015

(30) Foreign Application Priority Data

Jul. 25, 2012 (JP) ..... 2012-164320
Mar. 8, 2013 (JP) ..... 2013-046319

(51) Int. Cl.
*F04B 39/12* (2006.01)
*F04B 17/03* (2006.01)
(Continued)

(52) U.S. Cl.
CPC ..... *F04B 17/03* (2013.01); *F04B 39/0061* (2013.01); *F04B 39/12* (2013.01); *F04C 29/04* (2013.01); *F04C 29/065* (2013.01)

(58) Field of Classification Search
CPC .. F04B 35/04; F04B 39/0055; F04B 39/0061; F04B 39/12; F04B 17/03; F04C 29/065; F04C 29/04
(Continued)

(56) References Cited

U.S. PATENT DOCUMENTS 3,044,688 A * 7/1962 Frank ..... F04B 39/0044 417/312
5,201,640 A 4/1993 Heinzelmann et al.
(Continued)

FOREIGN PATENT DOCUMENTS

JP 7-305697 11/1995
JP 2000-291556 10/2000
(Continued)

*Primary Examiner* — Nathan Zollinger
(74) *Attorney, Agent, or Firm* — Hamre, Schumann, Mueller & Larson, P.C.

(57) ABSTRACT

A sealed compressor of the present invention comprises an electric component (111); a compression component (113) actuated by the electric component (111); and a sealed container (101) which accommodates therein the electric component (111) and the compression component (113), and stores lubricating oil therein; wherein the compression component (113) includes a crankshaft (135) including a main shaft (137) and an eccentric shaft (139); a cylinder block (117) including a bearing unit (123) supporting the main shaft (137) such that the main shaft is rotatable, and a cylinder (121) defining a compression chamber (119); and a suction muffler (131) through which a refrigerant gas (115) flows from an interior of the sealed container (101) to an interior of the compression chamber (119); a separating wall (165) is provided between the suction muffler (131) and the
(Continued)

electric component (111); a first space (159) is formed between the suction muffler (131) and the separating wall (165); and a second space (163) is formed between the electric component (111) and the separating wall (165).

12 Claims, 13 Drawing Sheets

(51) Int. Cl.
*F04B 39/00* (2006.01)
*F04C 29/04* (2006.01)
*F04C 29/06* (2006.01)

(58) Field of Classification Search
USPC ..... 181/403; 417/312
See application file for complete search history.

(56) References Cited

U.S. PATENT DOCUMENTS 5,330,329 A * 7/1994 Clark ..... F04B 39/123 181/403
2009/0162220 A1* 6/2009 Hoefer ..... F04D 19/042 417/410.1

FOREIGN PATENT DOCUMENTS

JP 3225090 B 11/2001
JP 2004-44519 2/2004
JP 2009-138697 6/2009
JP 2011-111930 6/2011
JP 2012-82782 4/2012
WO WO 2011154430 A2 * 12/2011 ..... F04B 35/04

* cited by examiner

100
UPPER
117
101
115
139
143
102
141
119
113
125
145
146
120
127
118
133
157
131
147
150
153
LEFT
RIGHT
103
111
106
109
135
131
137
105
107
163
159
165
LOWER

SEALED COMPRESSOR AND REFRIGERATION UNIT INCLUDING SEALED COMPRESSOR

TECHNICAL FIELD

The present invention relates to a sealed compressor for use in electric refrigerator-freezers for household uses, show cases, etc., and a refrigeration unit including the sealed compressor. Particularly, the present invention relates to the configuration of the sealed compressor.

BACKGROUND ART

In recent years, there have been increasing demands for global environmental conservation. It is strongly demanded that sealed compressors for use in electric refrigerator-freezers for household uses, other refrigeration cycle units, etc. have a higher efficiency.

Conventionally, as such a sealed compressor, there is a sealed compressor which includes a resin-made suction muffler (see e.g., Patent Literature 1).

FIG. 12 is a longitudinal sectional view of the sealed compressor disclosed in Patent Literature 1. FIG. 13 is a transverse-sectional view of the sealed compressor disclosed in Patent Literature 1.

As shown in FIGS. 12 and 13, the sealed compressor disclosed in Patent Literature 1 includes a sealed container 1 and a compressor body 7. In the bottom portion of the sealed container 1, lubricating oil 3 is stored. In the interior of the sealed container 1, a refrigerant gas 5 is filled, and the compressor body 7 is elastically supported on the sealed container 1 by a suspension spring 9. The compressor body 7 includes an electric component 11 and a compression component 13 disposed above the electric component 11.

The electric component 11 includes a stator 15 and a rotor 17. The compression component 13 includes a cylinder block 21 defining a cylinder 19, a piston 23 which is reciprocatable within the cylinder 19, a valve plate 25 which closes the end surface of the cylinder 19, a cylinder head 27 covering the valve plate 25, a suction muffler 29, a crankshaft 35 having an eccentric shaft 31 and a main shaft 33, and a joining means 37 for joining the eccentric shaft 31 and the piston 23 to each other.

The cylinder block 21 includes a bearing unit 39 supporting the main shaft 33 such that the main shaft 33 is rotatable. Discharge holes 41*a*, 41*b*, and 41*c* of the lubricating oil 3 are provided to surround the bearing unit 39.

A compression chamber 43 is defined by the cylinder 19, the valve plate 25, and the piston 23. A suction muffler 29 is retained between the valve plate 25 and the cylinder head 27.

CITATION LIST

Patent Literature

Patent Literature 1: Japanese Patent No. 3225090

SUMMARY OF INVENTION

Technical Problem

However, in the sealed compressor disclosed in Patent Literature 1, since the surface of the suction muffler 29 which faces the electric component 11 is placed in a high-temperature ambience due to heat generation of the electric component 11. As a result, the refrigerant gas 5 flowing through the interior of the suction muffler 29 raises its temperature under the influence of the heat transferred from the surface which faces the electric component 11. Under the circumstance, the volumetric efficiency of the refrigerant gas 5 decreases.

The present invention is directed to solving the problems associated with the prior art, and an object is to provide a sealed compressor which is capable of suppressing a temperature increase in a refrigerant gas flowing through the interior of the suction muffler, and operating with a high efficiency, and a refrigeration unit including the sealed compressor.

Solution to Problem

To solve the above problem associated with the prior art, there is provided a sealed compressor comprising: an electric component; a compression component actuated by the electric component; and a sealed container which accommodates therein the electric component and the compression component, and stores lubricating oil therein; wherein the compression component includes a crankshaft including a main shaft and an eccentric shaft; a cylinder block including a bearing unit supporting the main shaft of the crankshaft such that the main shaft is rotatable, and a cylinder defining a compression chamber; and a suction muffler through which a refrigerant gas flows from an interior of the sealed container to an interior of the compression chamber; wherein a separating wall is provided between the suction muffler and the electric component; a first space is formed between the suction muffler and the separating wall; and a second space is formed between the electric component and the separating wall.

In this configuration, since it becomes possible to suppress heat from being transferred from the electric component in a high-temperature state to the suction muffler in a low-temperature state, a temperature increase in the refrigerant gas flowing through the interior of the suction muffler can be suppressed, and the volumetric efficiency of the refrigerant gas can be made higher.

Advantageous Effects of Invention

A sealed compressor and a refrigeration unit including the sealed compressor of the present invention can suppress a temperature increase in the refrigerant gas flowing through the interior of the suction muffler, and thereby improve the volumetric efficiency of the refrigerant gas. Therefore, the efficiency of the sealed compressor can be increased.

DESCRIPTION OF EMBODIMENTS

Figure 1:
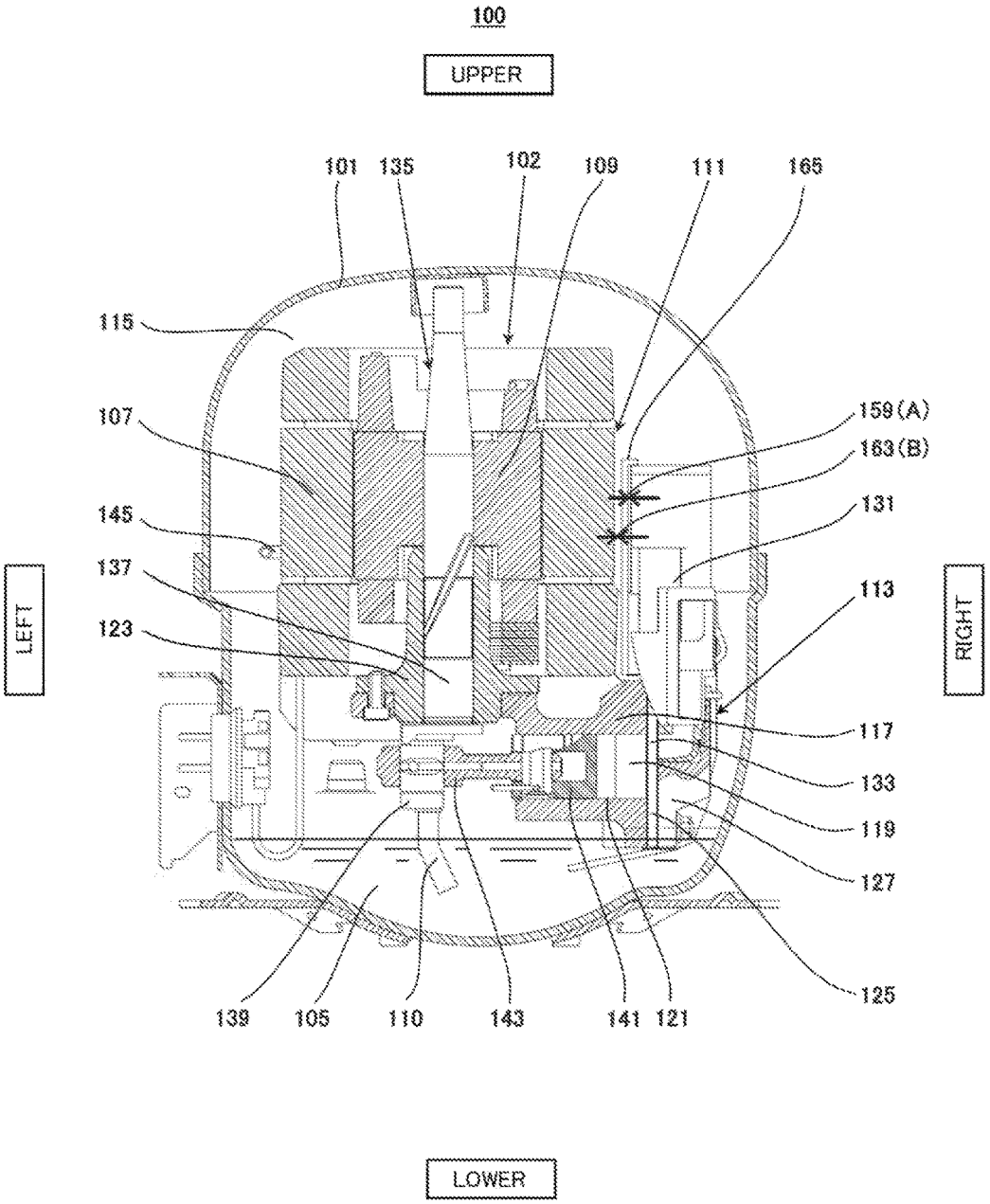
FIG. 1 is a cross-sectional view of a sealed compressor according to Embodiment 1, which is taken along a vertical direction.

According to the present invention, there is provided a sealed compressor comprising: an electric component; a compression component actuated by the electric component; and a sealed container which accommodates therein the electric component and the compression component, and stores lubricating oil therein; wherein the compression component includes a crankshaft including a main shaft and an eccentric shaft; a cylinder block including a bearing unit supporting the main shaft of the crankshaft such that the main shaft is rotatable, and a cylinder defining a compression chamber; a suction muffler through which the refrigerant gas flows from an interior of the sealed container to an interior of the compression chamber; wherein a separating wall is provided between the suction muffler and the electric component; a first space is formed between the suction muffler and the separating wall; and a second space is formed between the electric component and the separating wall.

In this configuration, it becomes possible to suppress heat from being transferred from the electric component in a high-temperature state to the suction muffler in a low-temperature state. In addition, it becomes possible to suppress lubricating oil in a high-temperature state scattered from a rotor from adhering onto the suction muffler. Therefore, a temperature increase in the refrigerant gas flowing through the interior of the suction muffler can be suppressed, and the volumetric efficiency of the refrigerant gas can be made higher.

The sealed compressor of the present invention may further comprise: a suction pipe provided to penetrate a wall of the sealed container and configured to flow therethrough a refrigerant gas suctioned into the sealed container; the suction muffler may be placed such that a suction port of the suction muffler is positioned in the vicinity of an outlet of the suction pipe; and the separating wall may cover a rear end portion of the suction muffler which is located on an upstream side in a flow direction of the refrigerant gas induced in an interior of the sealed container by rotation of the electric component.

In this configuration, even when the refrigerant gas in a high-temperature state in the interior of the sealed container flows through the interior of the sealed container and toward the rear end portion of the suction muffler, due to the rotation of the electric component, heat transfer to the suction muffler can be suppressed. In addition, it becomes possible to suppress the refrigerant gas in a high-temperature state from flowing into the first space. Therefore, a temperature increase in the refrigerant gas flowing through the interior of the suction muffler can be suppressed more effectively, and the volumetric efficiency of the refrigerant gas can be made higher.

In the sealed compressor of the present invention, the separating wall may cover a front end portion of the suction muffler.

In this configuration, it becomes possible to guide the refrigerant gas discharged from the outlet of the suction pipe to the interior of the suction muffler, at a larger amount. In addition, since the heat transfer from the refrigerant gas in a high-temperature state in the interior of the sealed container to the front end portion of the suction muffler can be suppressed, a temperature increase in the refrigerant gas flowing through the interior of the suction muffler can be suppressed more effectively, and the volumetric efficiency of the refrigerant gas can be made higher.

In the sealed compressor of the present invention, the separating wall may cover at least a portion of a back surface of the suction muffler which portion projects a refrigerant passage within the suction muffler.

In the sealed compressor of the present invention, the separating wall may cover an entire of a back surface of the suction muffler.

In the sealed compressor of the present invention, the separating wall may be mounted to the suction muffler.

In this configuration, since the separating wall and the suction muffler are integrated and assembled, the productivity of the sealed compressor can be increased.

In the sealed compressor of the present invention, the electric component may include a stator fastened to the cylinder block, and a rotor fastened to the crankshaft; and the separating wall may be mounted to the stator.

In the sealed compressor of the present invention, the separating wall may extend upward father than an upper end of the stator.

In this configuration, it becomes possible to more effectively suppress the lubricating oil in a high-temperature state which is scattered from the rotor from adhering onto the suction muffler. Therefore, a temperature increase in the refrigerant gas flowing through the interior of the suction muffler can be suppressed more effectively, and the volumetric efficiency of the refrigerant gas can be made higher.

In the sealed compressor of the present invention, the stator may have a salient-pole structure in which concentrated windings are wound around salient poles.

In this configuration, since the coil end of stator winding is as high as or lower than the end ring of the rotor, the lubricating oil is more scattered from the rotor. However, the separating wall can suppress the lubricating oil in a high-temperature state from adhering onto the suction muffler.

In the sealed compressor of the present invention, the electric component may be driven at one of a plurality of operating frequencies.

In this configuration, even when the electric component is driven at any one of the plurality of operating frequencies, the heat transfer from the stator in a high-temperature state to the suction muffler in a low-temperature state can be suppressed, during a low-speed rotation in which the flow velocity of the refrigerant gas flowing through the interior of the suction muffler is low. On the other hand, during a high-speed rotation in which the amount of the lubricating oil scattered from the rotor is increased, it becomes possible to suppress the scattered lubricating oil in the high-temperature state from adhering onto the suction muffler.

In the sealed compressor, the electric component may be placed above the compression component.

A refrigeration unit of the present invention comprises the sealed compressor according to any of the above configurations.

Hereinafter, the embodiments of the present invention will be described with reference to the drawings. The present invention is not limited to the embodiments below. Throughout the drawings, the same or corresponding components are designated by the same reference numerals, and will not be described repeatedly. Further, in some cases, throughout the drawings, the components required to explain the present invention are extracted and illustrated, and the other components are not illustrated.

Embodiment 1

[Configuration of Sealed Compressor]

Figure 2:
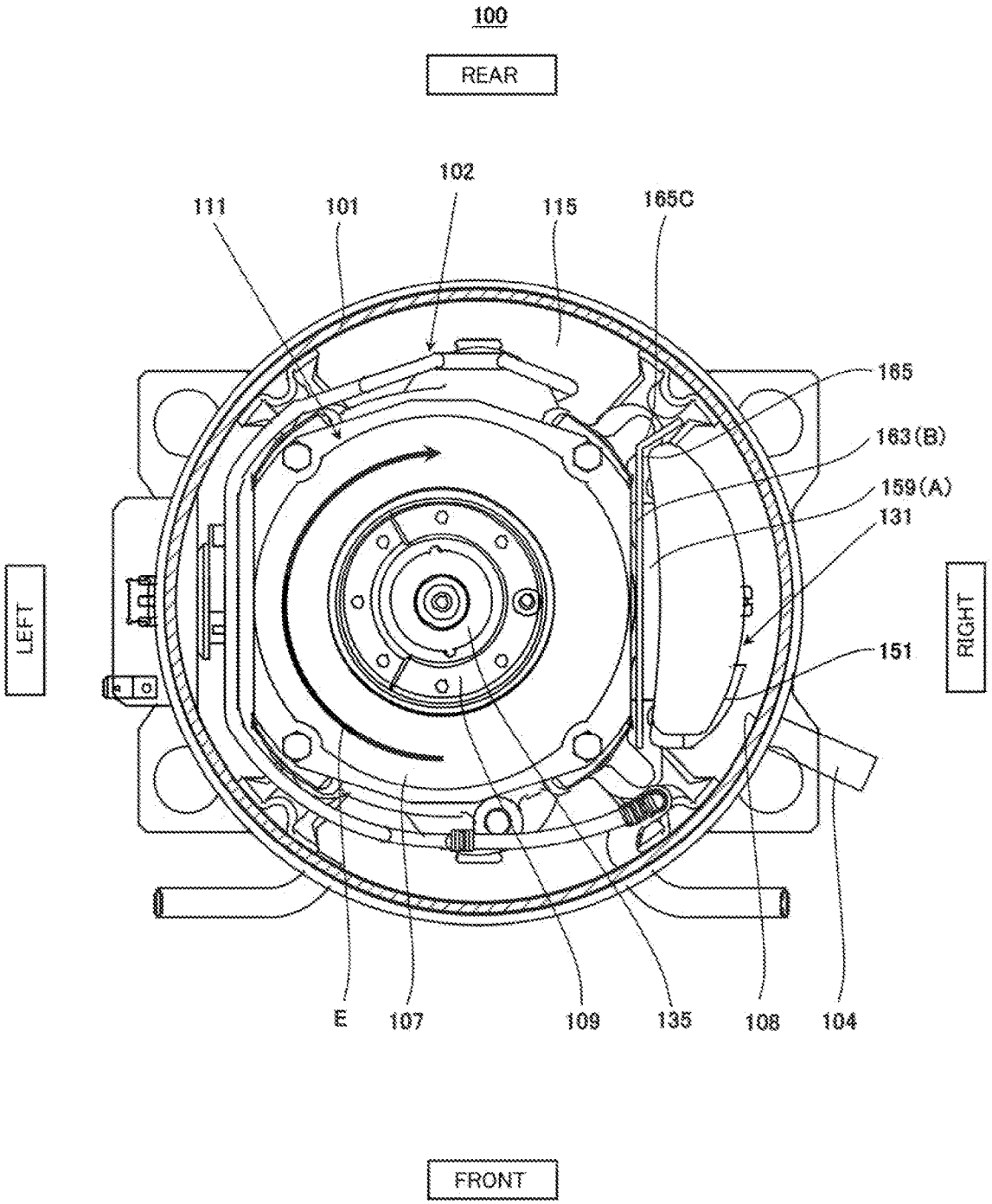
FIG. 2 is a cross-sectional view of the sealed compressor according to Embodiment 1, which is taken along a horizontal direction.

FIG. 1 is a cross-sectional view of a sealed compressor according to Embodiment 1, which is taken along a vertical direction. FIG. 2 is a cross-sectional view of the sealed compressor according to Embodiment 1, which is taken along a horizontal direction, and which is viewed from above.

In FIG. 1, the upper and lower sides and the right and left sides are the upper and lower sides and the right and left sides of the sealed compressor. In FIG. 2, the front and rear sides, and the right and left sides are the front and rear sides and the right and left sides of the sealed compressor.

As shown in FIGS. 1 and 2, a sealed compressor 100 according to Embodiment 1 includes a sealed container 101 and a compressor body 102 accommodated in the sealed container 101. The sealed container 101 is provided with a discharge pipe 103 (see FIG. 9) and a suction pipe 104 (see FIG. 2) which provide communication between inside and outside of the sealed container 101. The refrigerant gas supplied from a refrigeration unit (see FIG. 11) flows through the suction pipe 104. An opening 108 which is the downstream end (outlet) of the suction pipe 104 opens in the interior of the sealed container 101.

The sealed container 101 is manufactured by a drawing process of an iron plate. The compressor body 102 includes an electric component 111 and a compression component 113 actuated by the electric component 111, and is elastically supported on the sealed container 101 by a suspension spring 106 (see FIG. 9).

The sealed container 101 is filled with, for example, a refrigerant gas 115 such as hydrocarbon-based R600a (isobutene) which is low in global warming potential. Lubricating oil 105 is stored in a bottom portion of the sealed container 101.

In Embodiment 1, the electric component 111 is disposed above the compression component 113 (upper side in the interior of the sealed container 101) and is actuated at a constant operating frequency. The electric component 111 includes a stator 107 and a rotor 109.

The stator 107 is fastened to a cylinder block 117 as will be described later by means of a bolt (not shown). The rotor 109 is fastened to a main shaft 137 of a crankshaft 135 as will be described later in a position inward relative to the stator 107, by shrink-fitting or press-in such that the rotor 109 is coaxial with the stator 107.

The compression component 113 includes the crankshaft 135, the cylinder block 117, a piston 141, a joining means 143, etc. A high-pressure pipe 145 is connected to the compression component 113 to flow the refrigerant gas 115 compressed by the reciprocation motion of the piston 141 to the discharge pipe 133 fastened to the sealed container 101.

The crankshaft 135 includes the main shaft 137 having an axis extending vertically, the eccentric shaft 139 connected to the lower end of the main shaft 137, and an oil feeding mechanism 110. The oil feeding mechanism 110 includes a pipe extending downward from the eccentric shaft 139, a spiral groove provided on the surface of the main shaft 137, and the like, and is configured to feed the lubricating oil 105 to the bearing unit 123, the joining means 143, and the like.

The cylinder block 117 is provided with the bearing unit 123 having a cylindrical inner surface and having an axis oriented vertically. The main shaft 137 of the crankshaft 135 is rotatably inserted into the bearing unit 123.

The cylinder block 117 is provided with the cylindrical cylinder 121 having an axis oriented horizontally. The piston 141 is inserted into the cylinder 121 such that the piston 141 is advanceable and retractable. The eccentric shaft 139 is connected to the piston 141 via the joining means 143.

A valve plate 125 having a suction hole 118 and a discharge hole (not shown) is disposed at the end surface of the cylinder 121 which is more distant from the crankshaft 135. The valve plate 125 is provided with a suction valve 133 for opening and closing the suction hole 118, and a discharge valve (not shown) for opening and closing the discharge hole. The valve plate 125 and the piston 141 define a compression chamber 119.

Figure 9:
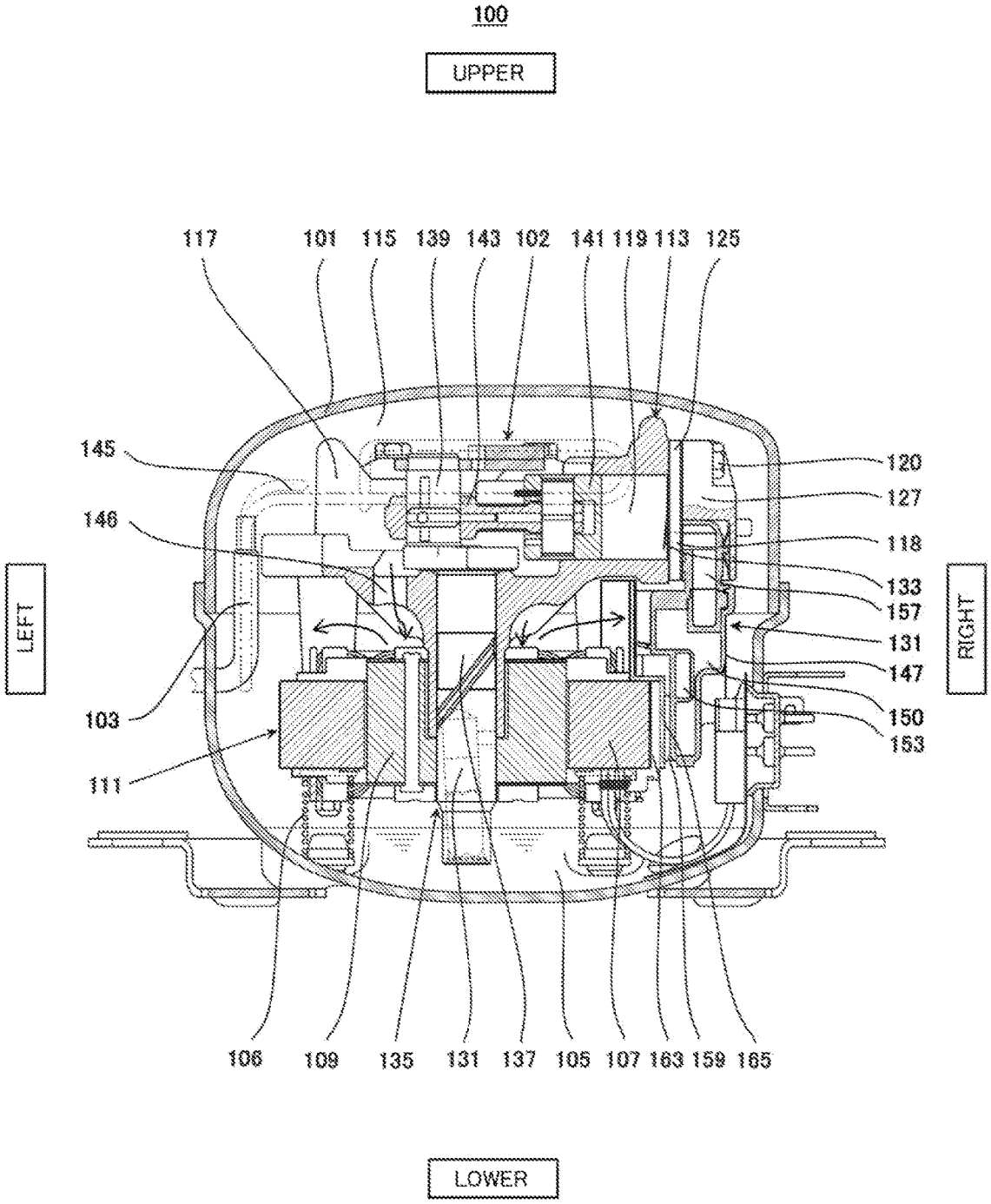
FIG. 9 is a cross-sectional view of a sealed compressor according to Embodiment 2, which is taken along a vertical direction.

The valve plate 125 and a cylinder head 127 disposed to cover the valve plate 125 are fitted together to the cylinder block 117 by using a head bolt 120 (see FIG. 9). A discharge chamber (not shown) is formed in the cylinder head 127.

A suction muffler 131 is retained between the valve plate 125 and the cylinder head 127. In Embodiment 1, the suction muffler 131 is provided with a suction port 151 as will be described later in the vicinity of the outlet (exit) of the suction pipe 104.

The suction muffler 131 is a silencer (muffler) as a means which attenuates a noise generated in the compression chamber 119 or the suction valve 133. To improve performance of a sealed compressor 100, the suction muffler 131 is desirably formed of a material which is low in heat conductivity, for example, a synthetic resin. In view of the fact that the suction muffler 131 is used under a refrigerant gas ambience, and a high-temperature state, for example, PBT (polybutylene terephthalate), PPS (polyphenylene sulfide), etc., may be used.

Hereinafter, the suction muffler 131 will be described in detail with reference to FIGS. 1 to 4.

Figure 3:
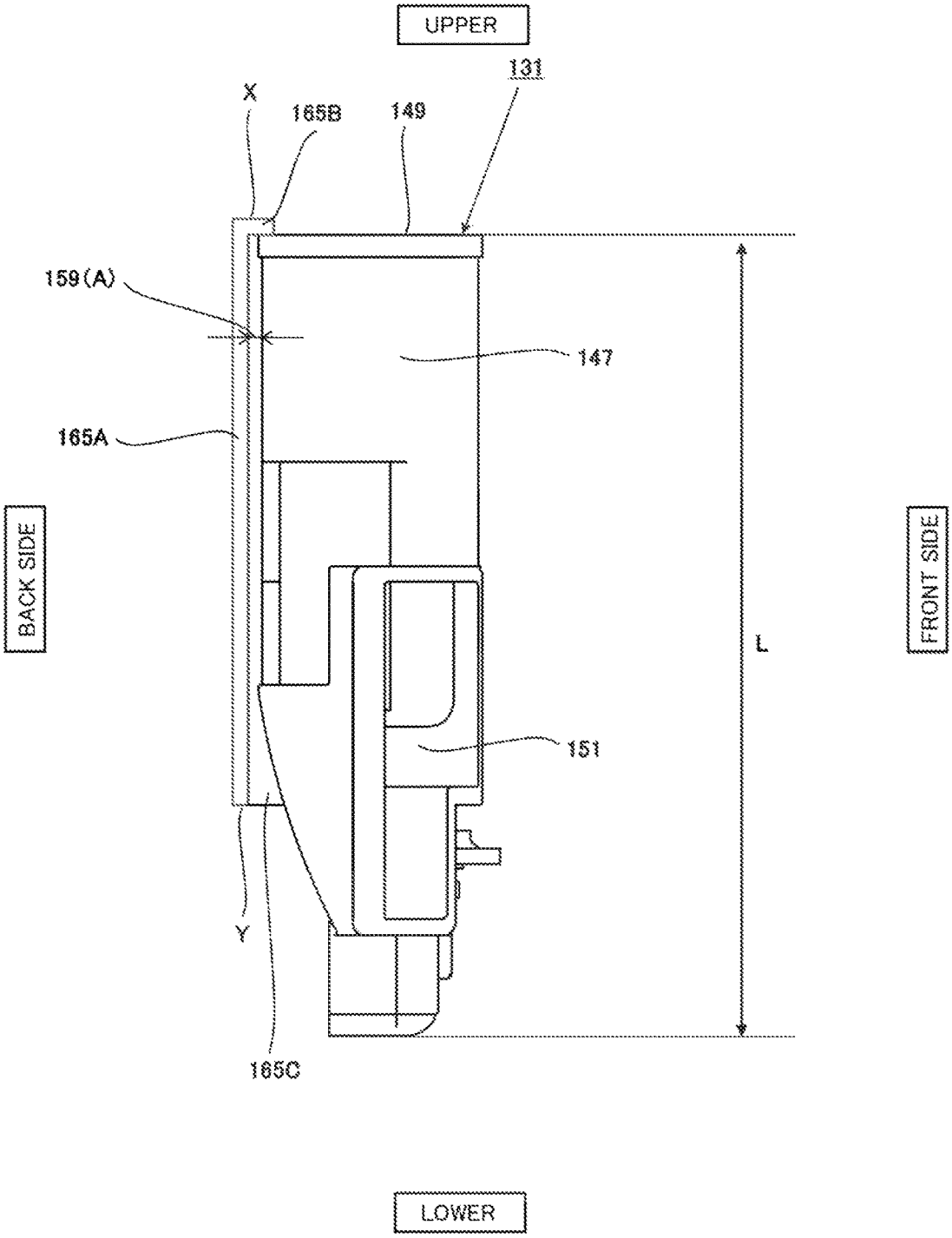
FIG. 3 is a side view showing the schematic configuration of a suction muffler and a separating wall of the sealed compressor of FIG. 1.
Figure 4:
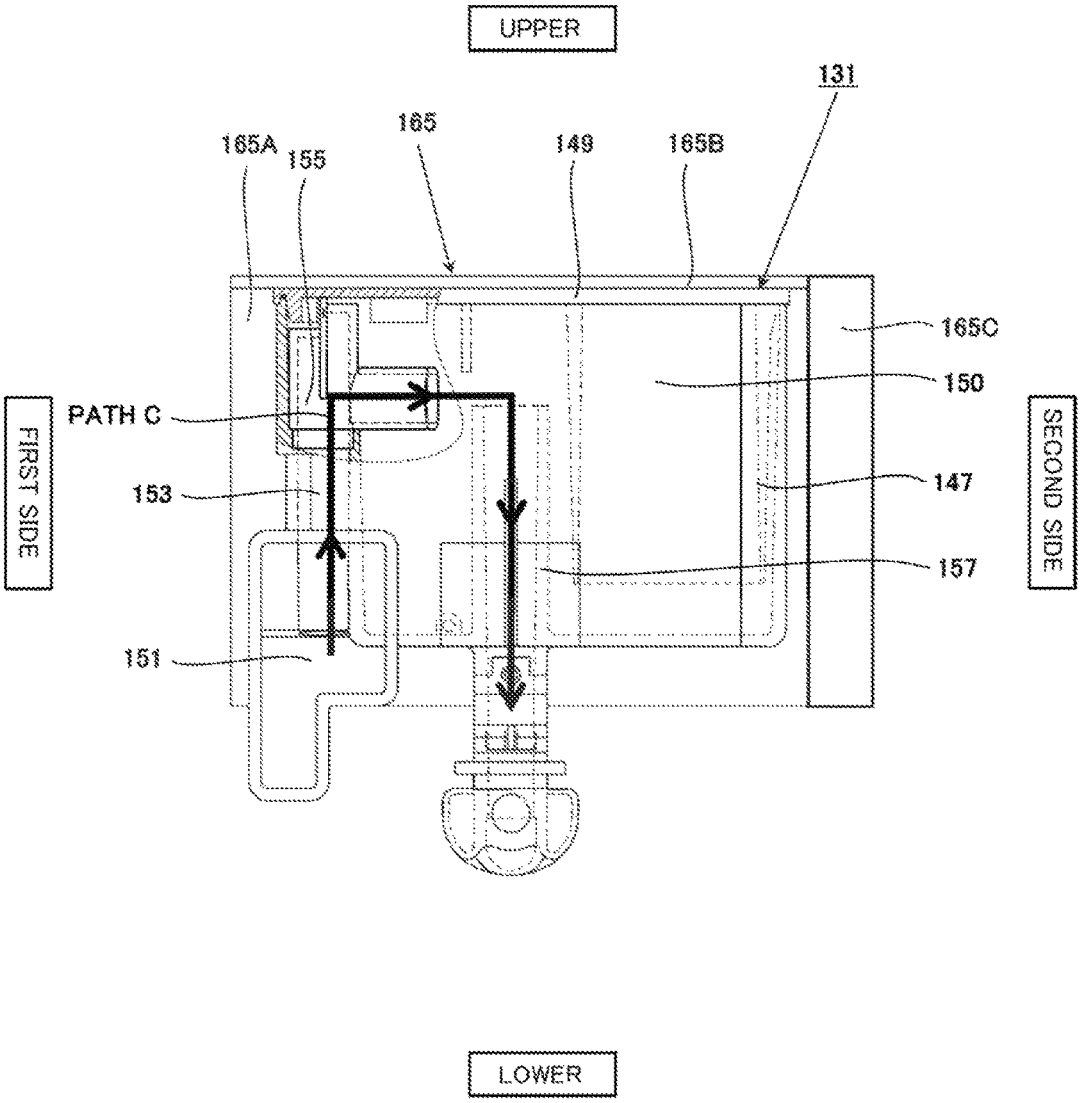
FIG. 4 is a front view showing the schematic configuration of the suction muffler and the separating wall of the sealed compressor of FIG. 1.

FIG. 3 is a side view showing the schematic configuration of the suction muffler and the separating wall of the sealed compressor of FIG. 1. FIG. 4 is a front view showing the schematic configuration of the suction muffler and the separating wall of the sealed compressor of FIG. 1.

In FIGS. 3 and 4, the upper and lower sides of the suction muffler are depicted as the upper and lower sides of FIGS. 3 and 4. The front side of FIG. 3 corresponds to the right side of FIGS. 1 and 2, while the back side corresponds to the left side of FIGS. 1 and 2. Also, the first side of FIG. 4 corresponds to the front side of FIGS. 1 and 2, while the second side of FIG. 4 corresponds to the rear side of FIGS. 1 and 2.

As shown in FIGS. 1 to 4, the suction muffler 131 includes a muffler body 147, a muffler cover 149, an inlet pipe (tail pipe) 153, and an outlet pipe (communication pipe) 157. Typically, after these components are assembled, the muffler body 147 and the muffler cover 149 are joined together, by ultrasonic welding, or the like, thereby completing the suction muffler 131.

The muffler body 147 has a rectangular parallelepiped shape which is laterally elongated and has a specified thickness. The inner space of the muffler body 147 defines a muffling space 150. The muffler cover 149 is disposed so as to cover the upper end portion of the muffler body 147.

The inlet pipe 153 has a tubular shape. The inlet pipe 153 is disposed such that one end thereof opens in the muffling space 150, and the suction port 151 which is the other end of the inlet pipe 153 opens in the interior of the sealed container 101. The inlet pipe 153 has a L-shaped bent portion 155. The outlet pipe 157 has a tubular shape. The outlet pipe 157 is disposed such that one end thereof opens in the muffling space 150 and the other end thereof communicates with the compression chamber 119.

The refrigerant gas is supplied to the compression chamber 119 through the suction port 151, the inlet pipe 153 (including the bent portion 155 in its intermediate portion), the muffling space 150, and the outlet pipe 157. A U-shaped passage including the suction port 151, the inlet pipe 153 (including the bent portion 155 in its intermediate portion), the muffling space 150, and the outlet pipe 157 will be hereinafter referred to as a refrigerant passage C (see FIG. 4).

A separating wall 165 is placed between the suction muffler 131 and the electric component 111 (see FIGS. 1 and 2). More specifically, the separating wall 165 is placed such that a first space 159 (also will be referred to as space A) is formed between the back surface of the suction muffler 131 (muffler body 147) and the front surface of the separating wall 165, and a second space 163 (also will be referred to as space B) is formed between the side surface (peripheral surface of the stator 107) of the electric component 111 and the front surface of the separating wall 165.

In Embodiment 1, the distance (minimum distance) between the suction muffler 131 and the separating wall 165 is set to 2 mm, the thickness of the separating wall 165 is set to 2 mm, and the distance (minimum distance) between the electric component 111 and the separating wall 165 is set to 2 mm.

It should be noted that the separating wall 165 is not placed between the inner wall of the sealed container 101 and the front surface of the suction muffler 131 which surface faces the inner wall. In other words, the separating wall 165 is placed to form a double wall structure but does not surround the entire suction muffler 131 (a part of the suction muffler 131 is surrounded by the separating wall 165).

In this structure, the structure and configuration of the suction muffler 131 are simpler than in a case where the entire suction muffler 131 has a double wall structure. Therefore, the productivity of the sealed compressor 100 can be improved. In addition, the suction muffler 131 having the above structure can reduce the material used for the separating wall 165 as compared to the case where the entire suction muffler 131 has a double wall structure.

The separating wall 165 has a main surface 165A and a connection section 165B, and is formed in a L-shape. The connection section 165B is fastened to the upper portion (muffler cover 149) of the suction muffler 131. Although in Embodiment 1, the separating wall 165 is fastened to the upper portion of the suction muffler 131, the present invention is not limited to this. For example, the separating wall 165 may be fastened to the back surface of the suction muffler 131 or to the front end portion or rear end portion of the suction muffler 131.

The main surface 165A is formed to be substantially equal in size to the back surface of the suction muffler 131. This can suppress the heat radiation from the stator 107 to the entire suction muffler 131, which can more effectively suppress heat radiation to the refrigerant gas 115 flowing through the interior of the suction muffler 131.

The separating wall 165 (main surface 165A) may be formed such that its size (height) falls within a range described below. As shown in FIG. 3, when the height of the suction muffler 131 is expressed as L, the upper end X of the separating wall 165 (main surface 165A) may be in a desired position between ⅓×L height from the upper end of the suction muffler 131 and −⅓×L height from the upper end of the suction muffler 131. Also, the lower end Y of the separating wall 165 (main surface 165A) may be as high as the lowest portion of the portion of the outlet pipe 157 which portion is not accommodated within the cylinder head 127.

The upper end X of the separating wall 165 (main surface 165A) may be located to be approximately as high as the coil end of winding constituting the stator 107. This also makes it possible to suppress heat radiation from the coil end of the stator 107 of the electric component 111 to the entire suction muffler 131.

As a result, it becomes possible to more effectively lessen the degree to which the refrigerant gas 115 flowing through the interior of the suction muffler 131 is heated due to the heat radiation from the stator 107, the volumetric efficiency of the refrigerant gas can be made higher, and hence the efficiency of the sealed compressor 100 can be further improved.

In Embodiment 1, the main surface 165A is configured such that the rear end portion 165C is bent so as to cover the rear end portion of the suction muffler 131. As defined herein, the rear end portion of the suction muffler 131 refers to a portion located at an upstream side in a flow direction E (see FIG. 2) of the refrigerant gas 115 induced in the interior of the sealed container 101 due to the rotation of the electric component E (see FIG. 2), and refers to the second side in FIG. 4.

The rear end portion 165C of the main surface 165A may be formed so as to cover a part or entire of the rear end portion of the suction muffler 131. Or, the rear end portion 165C may be formed so as to close the first space 159.

The separating wall 165 may be formed of a material which is low in heat conductivity, for example, a synthetic resin. In view of the fact that the separating wall 165 is used under a refrigerant gas ambience, and a high-temperature state, for example, PBT (polybutylene terephthalate), PPS (polyphenylene sulfide), etc., may be used, as in the case of the suction muffler 131.

Since the separating wall 165 is formed of the same synthetic resin as that of the suction muffler 131, the separating wall 165 and the suction muffler 131 can be easily fastened together by using the ultrasonic welding, or the like. Specifically, the separating wall 165 can be engaged with and fastened to the muffler cover 149 by the ultrasonic welding.

[Operation and Advantages of Sealed Compressor]

Next, the operation and advantages of the sealed compressor 100 of Embodiment 1 configured as described above will be described.

Initially, when the electric component 111 is applied with a current, the current flows through the stator 107, to generate a magnetic field, causing the rotor 109 fastened to the main shaft 137 to rotate. According to the rotation of the rotor 109, the crankshaft 135 rotates, and the rotational motion of the eccentric shaft 139 is converted into a linear reciprocation motion via the joining means 143. The piston 141 reciprocates within the cylinder 121.

The refrigerant gas 111 which has flowed through the suction pipe 104 and returned to the interior of the sealed container 101 is suctioned to the interior of the compression chamber 119 via the suction muffler 131, according to the reciprocation motion of the piston 141. The refrigerant gas 115 suctioned to the interior of the compression chamber 119 is compressed therein and then flows to the discharge pipe 103 via the high-pressure pipe 145. The refrigerant gas 115 exchanges heat while flowing from the discharge pipe 103 through a refrigeration unit, and flows to the suction pipe 104 again.

Next, a suction stroke and a compression stroke of the sealed compressor 100 will be descried more specifically.

When the piston 141 moves in a direction to increase the volume of the compression chamber 119, the refrigerant gas 115 in the interior of the compression chamber 119 expands. When the pressure in the interior of the compression chamber 119 falls below a suction pressure, the suction valve 133 starts to open due to a difference between the pressure in the interior of the compression chamber 119 and the pressure in the interior of the suction muffler 131.

According to this operation, the refrigerant gas 115 which has returned from the refrigeration cycle and is in a low-temperature state is released to the interior of the sealed container 101 from the opening 108 of the suction pipe 104. Then, the refrigerant gas 115 is suctioned from the suction port 151 of the suction muffler 131, and flows into the compression chamber 119 through the inlet pipe 153 (including the bent portion 155 in the intermediate portion thereof), and the outlet pipe 157.

After that, when the piston 141 moves from a bottom dead center in a direction to reduce the volume of the interior of the compression chamber 119, the refrigerant gas 115 is compressed in the interior of the compression chamber 119, so that the pressure in the interior of the compression chamber 119 increases. Then, when the pressure in the interior of the compression chamber 119 exceeds the pressure in the interior of the suction muffler 131, the suction valve 133 is closed.

In general, to ensure a sufficient volume of the muffler body 147, the suction muffler 131 is typically disposed in the interior of the sealed container 101, in the vicinity of the stator 107 (electric component 111) where a space is easily ensured. This causes the side surface (back surface of the muffler body 147) of the muffler body 147 which is closer to the stator 107 to be heated by heat generation in the stator 107.

As a result, the refrigerant gas 115 flowing through the interior of the suction muffler 131 is heated via the back surface of the muffler body 147, and its temperature increases. When the temperature of the refrigerant gas 115 flowing into the compression chamber 119 increases, the density of the refrigerant gas 115 flowing into the compression chamber 119 decreases, so that the volume efficiency of the refrigerant gas 115 decreases.

For example, in a case where the refrigerant gas 115 in the space (hereinafter will be referred to as space C) formed between the suction muffler 131 and the electric component 111 is less likely to be biased by the flow of the gas induced in the interior of the sealed container 101 due to the rotation of the crankshaft 135, the flow of the refrigerant gas 115 in the space C is suppressed. In this case, change of the refrigerant gas 115 in the space C is suppressed, and the temperature of the refrigerant gas 115 further increases.

However, in the sealed compressor 100 according to Embodiment 1, the separating wall 165 is placed between the suction muffler 131 and the electric component 111 such that the separating wall 165 defines the first space 159 and the second space 163. This makes it possible to prevent the refrigerant gas 115 in the high-temperature state, which is present in the vicinity of the electric component 111 (stator 107) from moving toward the suction muffler 131. Because of this, it becomes possible to suppress the back surface of the suction muffler 131 (muffler body 147) from being heated, and hence a temperature increase in the refrigerant gas 115 flowing through the interior of the suction muffler 131.

Further, in Embodiment 1, the rear end portion 165C of the separating wall 165 is formed so as to cover the rear end portion of the suction muffler 131.

In this configuration, even when the refrigerant gas 115 in the high-temperature state in the interior of the sealed container 101 moves toward the rear end portion of the suction muffler 131 through the interior of the sealed container 101, due to the rotation of the electric component 111, the rear end portion 165C of the separating wall 165 can suppress heat transfer (heat radiation) to the suction muffler 131. In addition, the rear end portion 165C of the separating wall 165 can suppress the refrigerant gas 115 in the high-temperature state from flowing into the first space 159. This makes it possible to more effectively suppress a temperature increase in the refrigerant gas 115 flowing through the interior of the suction muffler 131, and therefore improve the volumetric efficiency of the refrigerant gas 115.

Further, in the sealed compressor 100 according to Embodiment 1, the electric component 111 is disposed above the compression component 113. In this structure, the electric component 111 is less likely to be cooled by the lubricating oil 105 as compared to the structure in which the electric component 111 is disposed below the compression component 113. Therefore, when a comparison is made between the configuration in which the electric component 111 is disposed above the compression component 113 and the configuration in which the electric component 111 is disposed below the compression component 113, the heat radiation from the electric component 111 can be suppressed more effectively, in the configuration in which the electric component 111 is disposed above the compression component 113, assuming that the heat generation amount of the electric component 111 is equal.

Although in the sealed compressor 100 according to Embodiment 1, the electric component 111 is driven at a constant (fixed) operating frequency, the present invention is not limited to this. For example, the electric component 111 may be connected to an inverter drive circuit outside the sealed compressor 100, and may be driven (inverter-driven) at any one of a plurality of operating frequencies.

When the electric component 111 is inverter-driven, the flow velocity of the refrigerant gas 115 flowing through the interior of the suction muffler 131 is low, during a low-speed rotation (running), so that the suction muffler 131 is more affected by the heat radiated from the stator 107. However, in Embodiment 1, since the separating wall 165 is placed in the space C so as to form the first space 159 and the second space 163, it becomes possible to suppress the heat radiation from the stator 107 of the electric component 111 to the refrigerant gas 115 flowing through the suction muffler 131.

Therefore, the sealed compressor 100 according to Embodiment 1 is more advantageous during the low-speed operation (running).

Next, sealed compressors according to modified examples of Embodiment 1 will be described.

Modified Example 1

Figure 5:
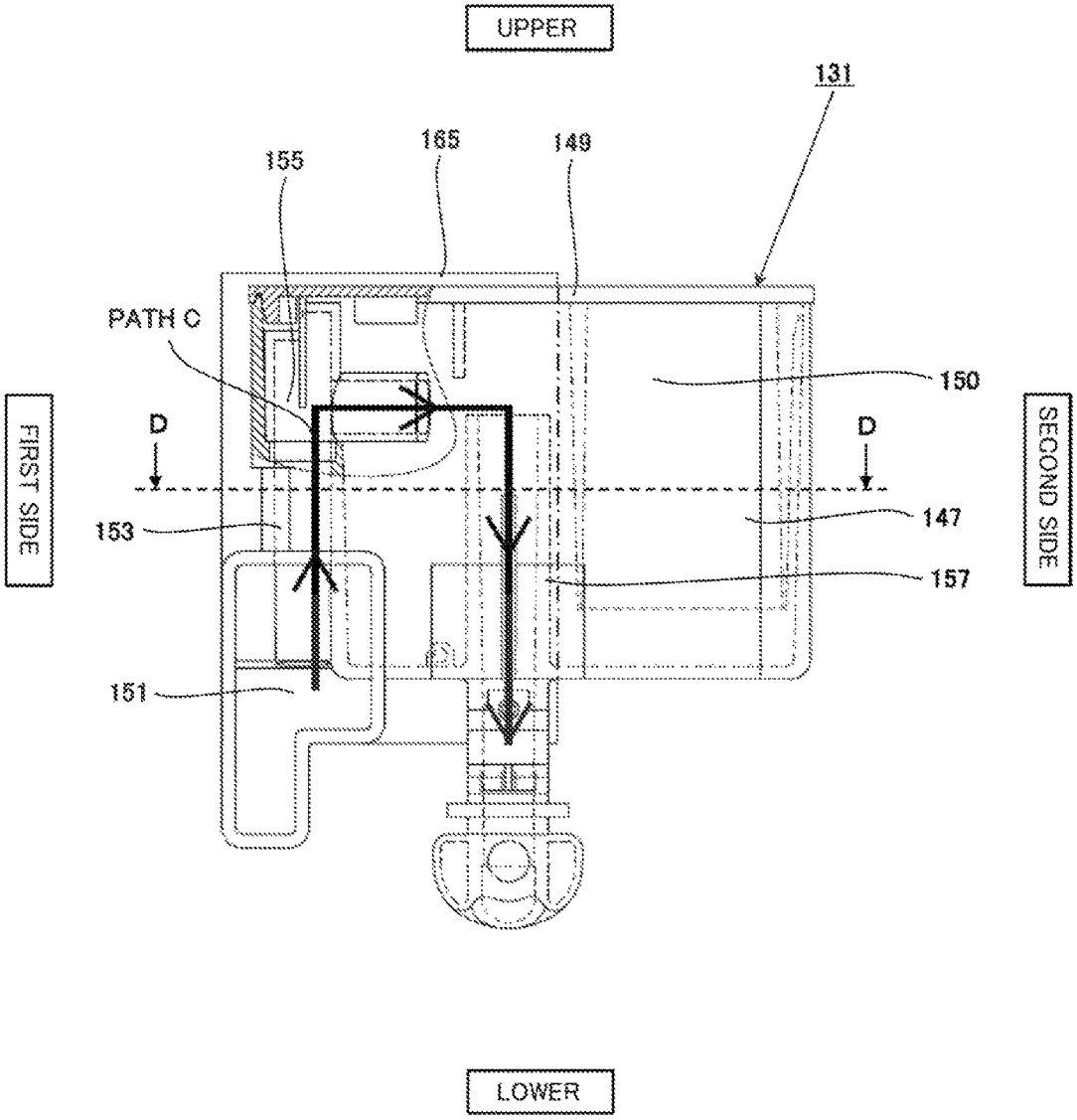
FIG. 5 is a side view showing the schematic configuration of a suction muffler and a separating wall of a sealed compressor according to Modified example 1 of Embodiment 1.
Figure 6:
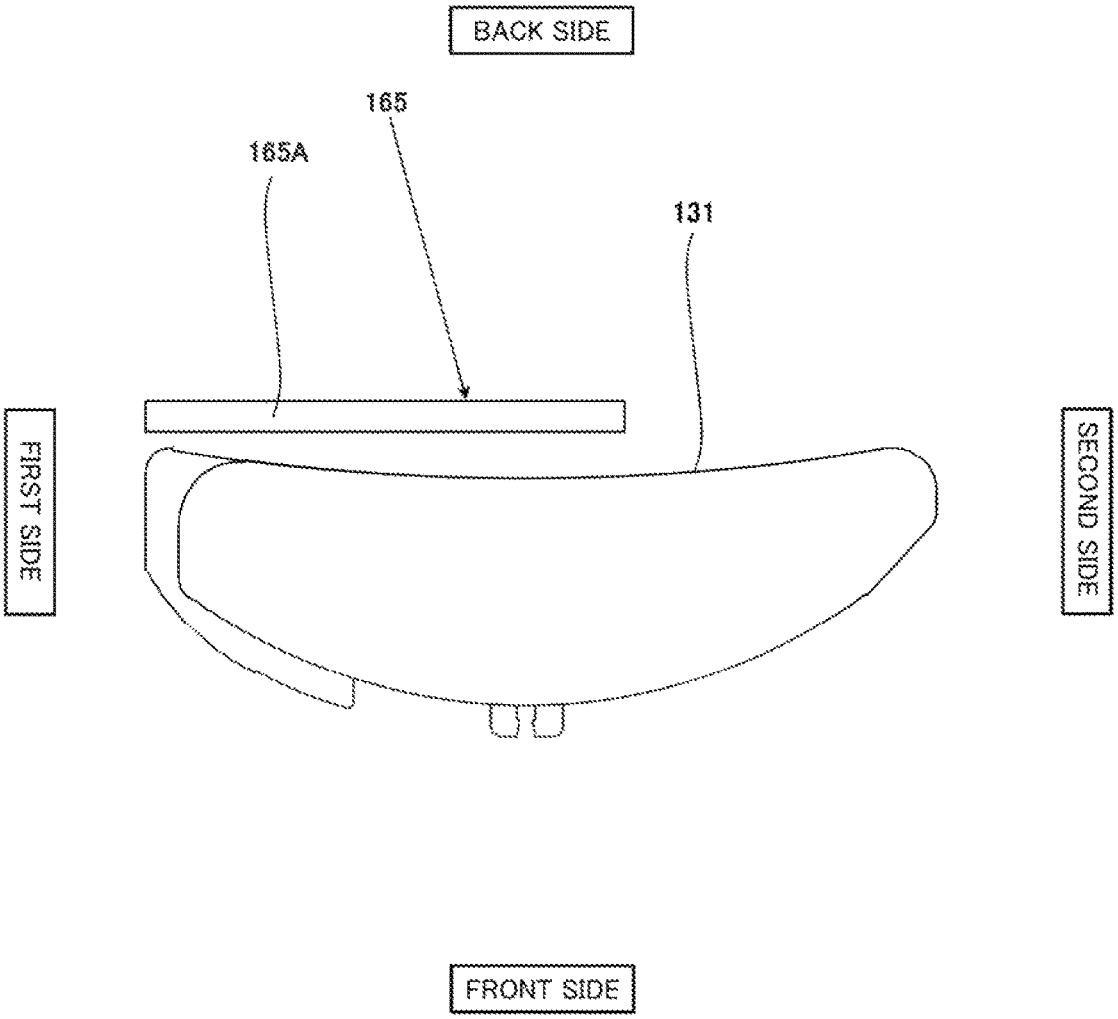
FIG. 6 is a cross-sectional view of the suction muffler and the separating wall, taken along D-D of FIG. 5.

FIG. 5 is a side view showing the schematic configuration of a suction muffler and a separating wall of a sealed compressor according to Modified example 1 of Embodiment 1. FIG. 6 is a cross-sectional view of the suction muffler and the separating wall, taken along D-D of FIG. 5. In FIG. 5, the upper and lower sides of the suction muffler are depicted as the upper and lower sides of FIG. 5.

As shown in FIGS. 5 and 6, a sealed compressor 100 according to Modified example 1 has basically the same configuration as that of the sealed compressor 100 according to Embodiment 1, but is different from the same in the shape of the separating wall 165. Specifically, the separating wall 165 (main surface 165A) does not cover the rear end portion of the suction muffler 131, but covers at least a portion of the back surface of the suction muffler 131 which portion projects a refrigerant passage C.

The sealed compressor 100 according to Modified example 1 configured as described above can suppress the heat radiation from the stator 107 of the electric component 111 to the refrigerant gas 115 flowing through the interior of the suction muffler 131.

Although in Modified example 1, the separating wall 165 is configured such that it covers a portion of the back surface of the suction muffler 131 which portion projects the refrigerant passage C, the present invention is not limited to this. The separating wall 165 may be configured to cover the entire back surface of the suction muffler 131 (the separating wall 165 may be substantially equal in size to the back surface of the suction muffler 131).

Modified Example 2

Figure 7:
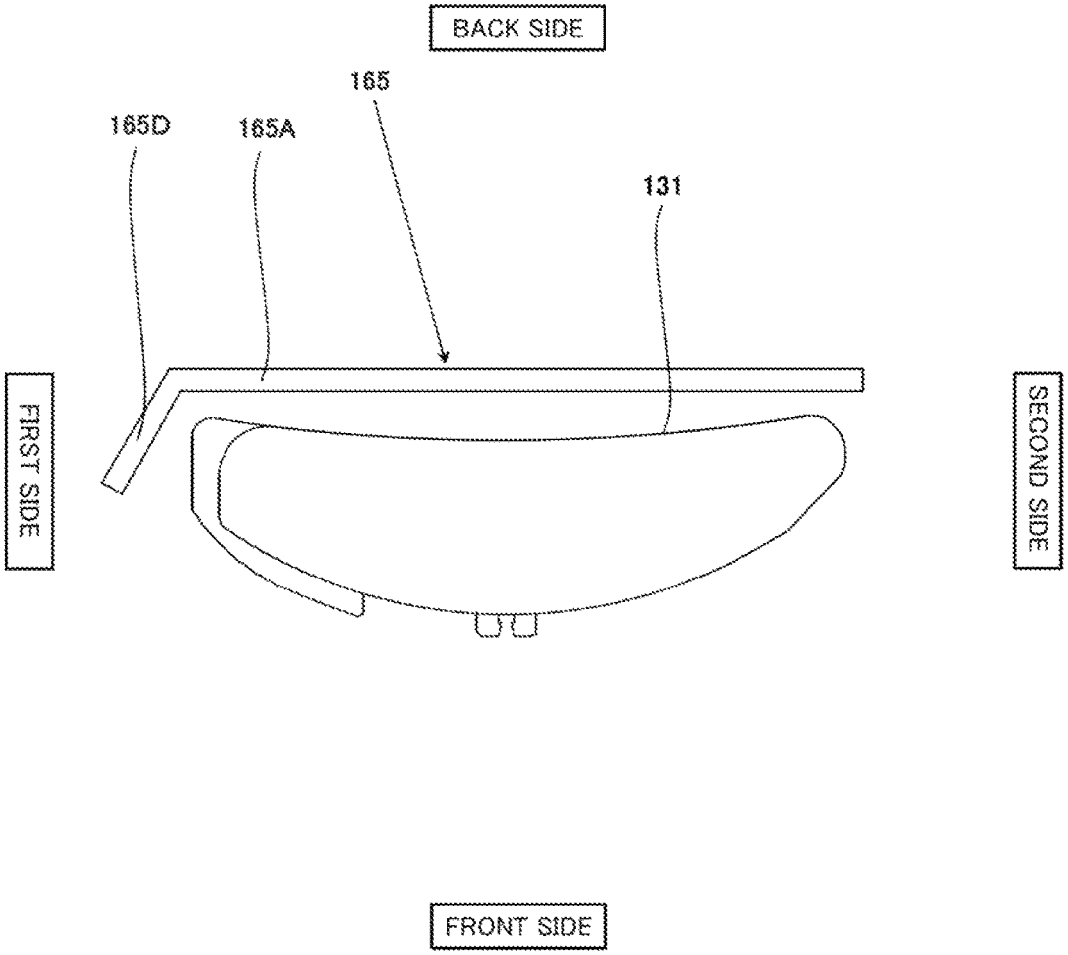
FIG. 7 is a cross-sectional view showing the schematic configuration of a suction muffler and a separating wall of a sealed compressor according to Modified example 2 of Embodiment 1.

FIG. 7 is a cross-sectional view showing the schematic configuration of a suction muffler and a separating wall of a sealed compressor according to Modified example 2 of Embodiment 1.

As shown in FIG. 7, the sealed compressor 100 according to Modified example 2 has basically the same configuration as that of the sealed compressor 100 according to Embodiment 1, but is different from the same in the shape of the separating wall 165. Specifically, the separating wall 165 (main surface 165A) does not cover the rear end portion of the suction muffler 131, but the front end portion 165D of the separating wall 165 is bent so as to cover the front end portion of the suction muffler 131. As defined herein, the front end portion of the suction muffler 131 refers to a portion located at a downstream side in the flow direction E (see FIG. 2) of the refrigerant gas 115 induced in the interior of the sealed container 101, due to the rotation of the electric component 111, and refers to the first side in FIG. 7.

The front end portion 165D of the main surface 165A may be formed so as to cover the entire or a part of the front end portion of the suction muffler 131. The front end portion 165D may be formed so as to close the first space 159.

The sealed compressor 100 according to Modified example 2 configured as described above can suppress the heat radiation from the stator 107 of the electric component 111 to the refrigerant gas 115 flowing through the interior of the suction muffler 131, as in the sealed compressor 100 according to Embodiment 1.

In addition, in the sealed compressor 100 according to Modified example 2, the front end portion 165D of the separating wall 165 allows the refrigerant gas 115 discharged from the outlet of the suction pipe 104 to be introduced at a larger amount into the suction muffler 131. Furthermore, since it becomes possible to suppress the heat transfer from the refrigerant gas 115 in the high-temperature state in the interior of the sealed container 101 to the front end portion of the suction muffler 131, it becomes possible to more effectively suppress a temperature increase in the refrigerant gas 115 flowing through the interior of the suction muffler 131, and hence the volumetric efficiency of the refrigerant gas can be made higher.

Modified Example 3

Figure 8:
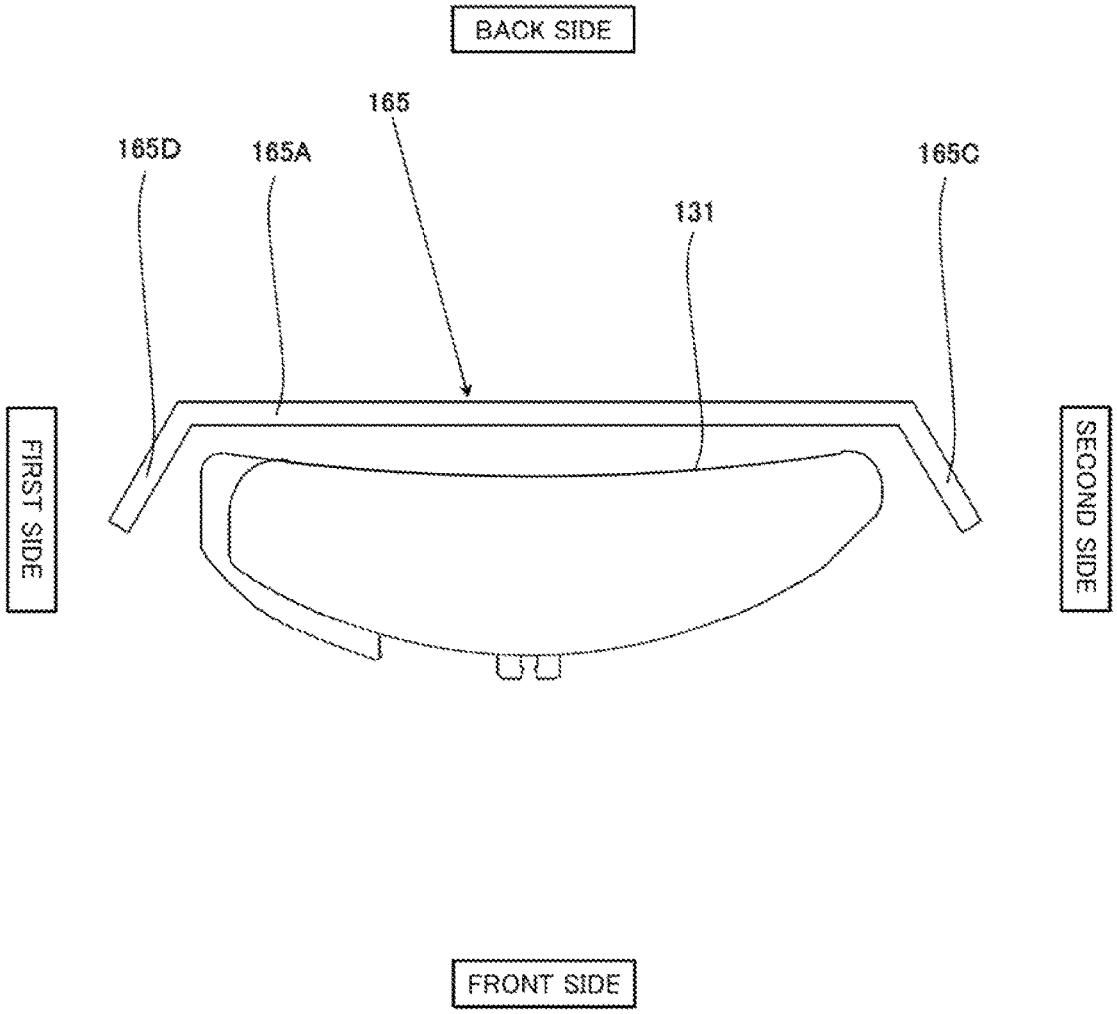
FIG. 8 is a cross-sectional view showing the schematic configuration of a suction muffler and a separating wall of a sealed compressor according to Modified example 3 of Embodiment 1.

FIG. 8 is a cross-sectional view showing the schematic configuration of a suction muffler and a separating wall of a sealed compressor according to Modified example 3 of Embodiment 1.

As shown in FIG. 8, the sealed compressor 100 according to Modified example 3 has basically the same configuration as that of the sealed compressor 100 according to Embodiment 1, but is different from the same in the shape of the separating wall 165. Specifically, the separating wall 165 (main surface 165A) is configured such that both of the rear end portion 165C and the front end portion 165D are bent so as to cover the rear end portion and the front end portion of the suction muffler 131, respectively.

The sealed compressor 100 according to Modified example 3 configured as described above can suppress the heat radiation from the stator 107 of the electric component 111 to the refrigerant gas 115 flowing through the interior of the suction muffler 131, as in the sealed compressor 100 according to Embodiment 1.

In addition, in the sealed compressor 100 according to Modified example 3, the refrigerant gas 115 discharged from the outlet of the suction pipe 104 can be introduced into the suction muffler 131 at a larger amount. Furthermore, since it becomes possible to suppress the heat transfer from the refrigerant gas 115 in the high-temperature state in the interior of the sealed container 101 to the front end portion of the suction muffler 131, it becomes possible to more effectively suppress a temperature increase in the refrigerant gas 115 flowing through the interior of the suction muffler 131, and hence the volumetric efficiency of the refrigerant gas can be made higher.

Embodiment 2

[Configuration of Sealed Compressor]

Figure 10:
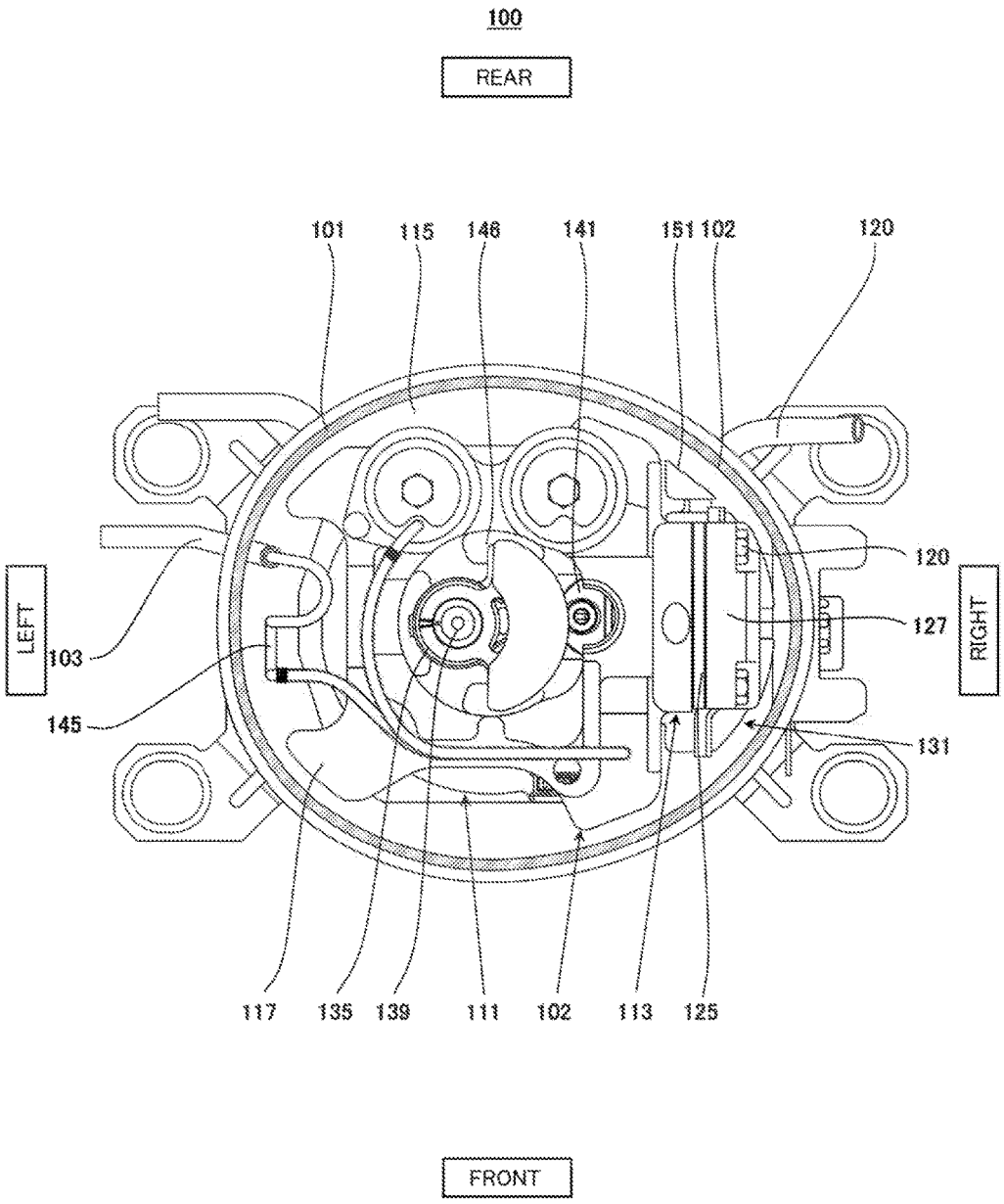
FIG. 10 is a cross-sectional view of a sealed compressor according to Embodiment 2, which is taken along a horizontal direction.

FIG. 9 is a cross-sectional view of a sealed compressor according to Embodiment 2, which is taken along a vertical direction. FIG. 10 is a cross-sectional view of the sealed compressor according to Embodiment 2, which is taken along a horizontal direction, and viewed from above.

In FIG. 9, the upper and lower sides and the right and left sides are the upper and lower sides and the right and left sides of the sealed compressor. In FIG. 10, the front and rear sides, and the right and left sides are the front and rear sides and the right and left sides of the sealed compressor.

As shown in FIGS. 9 and 10, the sealed compressor 100 according to Embodiment 2 has basically the same configuration as that of the sealed compressor 100 according to Embodiment 1, but is different from the same in that the compression component 113 is located above the electric component 111, and the cylinder block 117 has a discharge hole 146. The discharge hole 146 is provided in the bearing unit 123 of the cylinder block 117, and is formed by a through-hole which vertically penetrates the bearing unit 123.

In the sealed compressor 100 according to Embodiment 2, the separating wall 165 is mounted to the stator 107. Specifically, the separating wall 165 is fastened to the upper portion of the stator 107. More specifically, the separating wall 165 is fastened to the upper portion of the core portion of the stator 107 by fitting, caulking, etc.

The separating wall 165 extends upward father than the upper end of the stator 107. In Embodiment 2, the separating wall 165 extends to a position which is below and in the vicinity of the cylinder block 117. The stator 107 has a salient-pole structure in which concentrated winding is wound around salient poles (not shown).

[Operation and Advantages of Sealed Compressor]

Next, the operation and advantages of the sealed compressor 100 of Embodiment 2 will be described. The basic operation (suction stroke and compression stroke) of the sealed compressor 100 of Embodiment 2 is the same as that of the sealed compressor 100 of Embodiment 1, and will not be described in detail repeatedly. Here, the motion of the lubricating oil 105, which is caused by the operation of the sealed compressor 100 will be described.

The lubricating oil 105 stored in the bottom portion of the sealed container 101 is suctioned up from the lower end portion of the crankshaft 135 (main shaft 137) by a centrifugal force, according to the rotation of the crankshaft 135. The suctioned-up lubricating oil 105 is transported to the upper portion of the compression chamber 113 through the spiral groove provided on the surface of the main shaft 137. In the compression component 113, the lubricating oil 105 lubricates slide portions of the main shaft 137 and of the bearing unit 123, etc., and thereafter is scattered from the upper end of the eccentric shaft 139.

A part of the lubricating oil 105, which has been scattered from the eccentric shaft 139, is applied to the piston 141, the cylinder 121, etc., and lubricates the slide portions of the piston 141 and of the cylinder 121, etc. In contrast, another part of the lubricating oil 105, which has been scattered from the eccentric shaft 139, stays on the upper portion of the bearing unit 123 of the cylinder block 117. This lubricating oil 105 drops toward the electric component 111 through the discharge hole 146 provided in the cylinder block 117 (see FIG. 9). In the electric component 111, the lubricating oil 105 drops to the upper portion of the rotor 109, and is scattered to outside according to the rotation of the rotor 109.

The scattered lubricating oil 105 has been heated by the slide portions and the rotor 109, and therefore is in a high-temperature state. For this reason, when the lubricating oil 105 having been scattered from the rotor 109 and being in a high-temperature state adheres onto the suction muffler 131, the temperature of the suction muffler 131 is raised. This results in a situation in which the refrigerant gas 115 flowing through the interior of the suction muffler 131 is heated, the temperature of the refrigerant gas 115 flowing into the compression chamber 119 is increased, and the density of the refrigerant gas 115 flowing into the compression chamber 119 is decreased. As a result, the volumetric efficiency of the refrigerant gas 115 is reduced.

In particular, in the case where the sealed compressor 100 is inverter-driven, like Embodiment 2, the amount of the lubricating oil 105 scattered from the rotor 109 is increased during a high-speed rotation.

In the case where the stator 107 has the salient-pole structure, the coil end of the stator 107 is as high as or lower than the end ring of the rotor 109. Therefore, in this structure, the lubricating oil 105 having been scattered by the rotation of the rotor 109 is directly applied to the suction muffler 131.

However, in the sealed compressor 100 of Embodiment 2, since the separating wall 165 extends upward father than the upper end of the stator 107, it becomes possible to prevent the lubricating oil 105 from being applied to the suction muffler 131. Therefore, it becomes possible to suppress a temperature increase in the refrigerant gas 115 flowing through the interior of the suction muffler 131, and hence the volumetric efficiency of the refrigerant gas 115 can be made higher.

The sealed compressor 100 of Embodiment 2 configured as described above can achieve the advantages as those of the sealed compressor 100 of Embodiment 1. Also, as described above, in the case where the compression component 113 is placed above the electric component 111, the separating wall 165 extends upward father than the upper end of the stator 107. This can prevent the lubricating oil 105 from being applied to the suction muffler 131. Therefore, it becomes possible to suppress a temperature increase in the refrigerant gas 115 flowing through the interior of the suction muffler 131, and hence the volumetric efficiency of the refrigerant gas 115 can be made higher.

Embodiment 3

Figure 11:
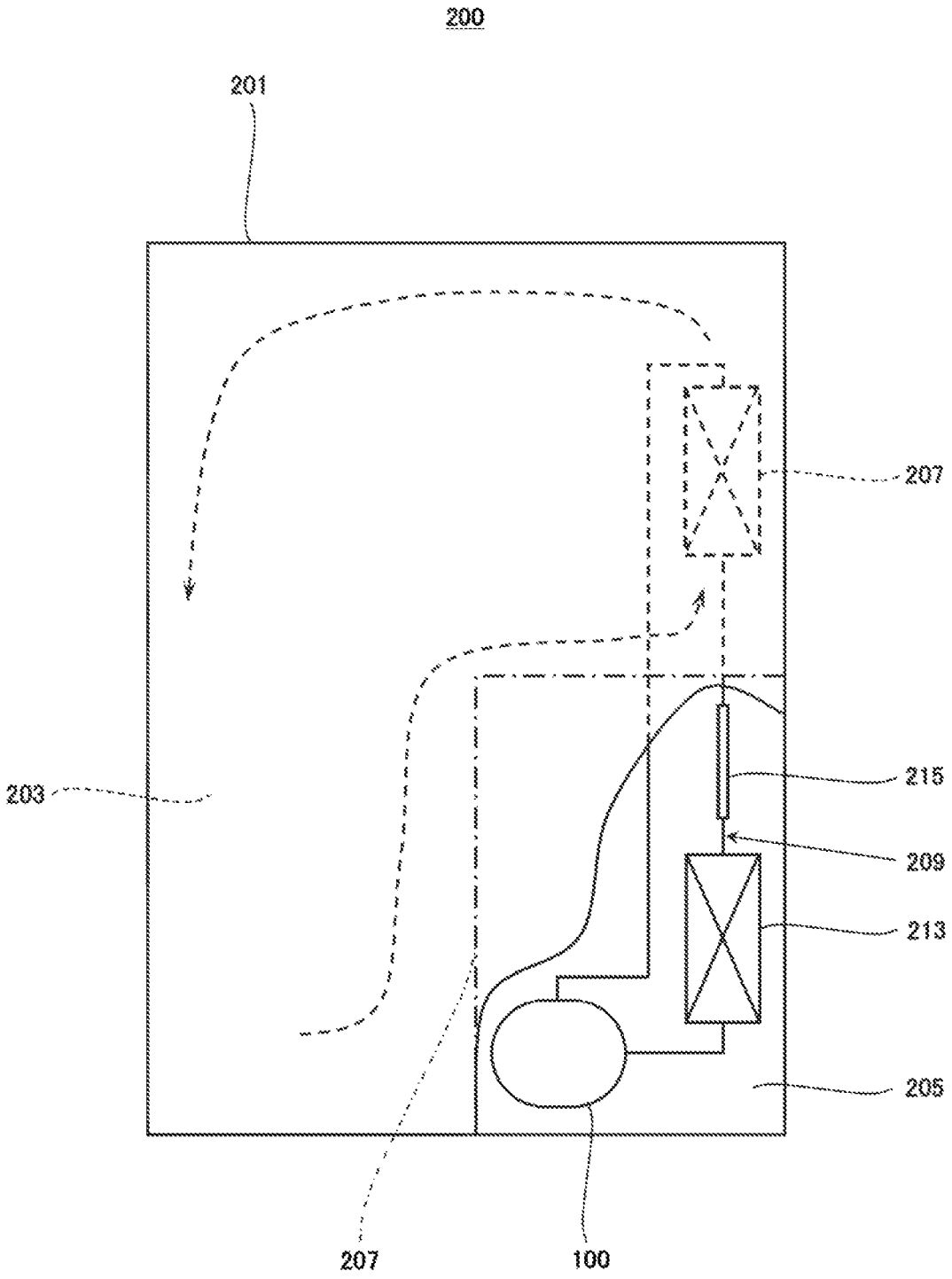
FIG. 11 is a schematic view showing a refrigeration unit according to Embodiment 3.
Figure 12:
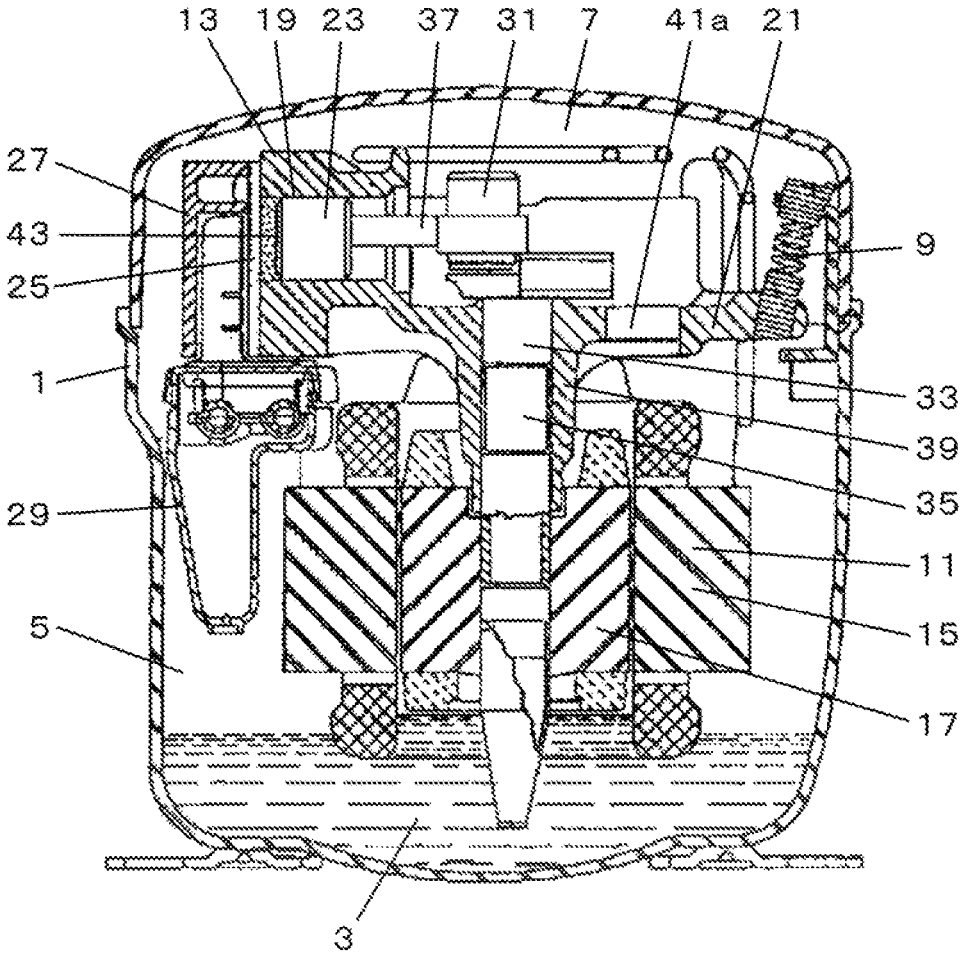
FIG. 12 is a longitudinal sectional view of the sealed compressor disclosed in Patent Literature 1.
Figure 13:
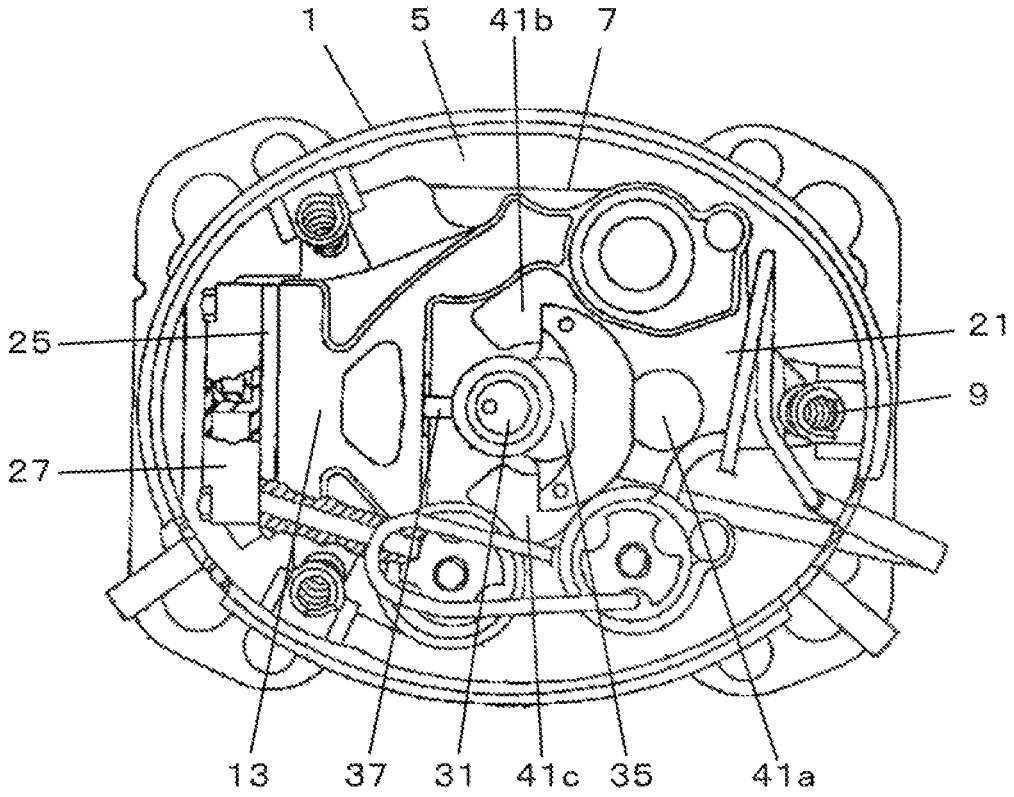
FIG. 13 is a transverse-sectional view of the sealed compressor disclosed in Patent Literature 1.

FIG. 11 is a schematic view showing the configuration of a refrigeration unit according to Embodiment 3.

In Embodiment 3, a refrigeration circuit is configured to include the sealed compressor 100 of Embodiment 1. The basic configuration of the refrigeration unit will now be described.

As shown in FIG. 11, a refrigeration unit 200 according to Embodiment 3 includes a body 201 including a heat insulating box member which is open at one side, and a door which opens and closes the opening, partition walls 207 which separates the interior of the body 201 into an article storage space 203 and a mechanical chamber 205, and a refrigerant circuit 209 for cooling the interior of the storage space 203.

The refrigerant circuit 209 is configured such that the sealed compressor 100 according to Embodiment 1, a heat radiator 213, a pressure-reducing device 215, and a heat absorber unit 217 are connected annularly by pipes. The heat absorber unit 217 is placed in the storage space 203 including a blower (not shown).

As indicated by the arrows of FIG. 11, cooling heat of the heat absorber unit 217 is stirred by the blower so as to be circulated within the storage space 203.

Since the refrigeration unit 200 according to Embodiment 3 configured as described above includes the sealed compressor 100 of Embodiment 1, it can achieve the same advantages as those of the sealed compressor 100 according to Embodiment 1. Electric power consumption of the refrigeration unit 200 can be reduced, and energy saving can be achieved.

Although the refrigeration unit 200 according to Embodiment 3 includes the sealed compressor 100 according to Embodiment 1, the present invention is not limited to this.

The refrigeration unit 200 may include the sealed compressor 100 according to any one of Modified examples 1 to 3 of Embodiment 1 or the sealed compressor 100 according to Embodiment 2.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

INDUSTRIAL APPLICABILITY

A sealed compressor of the present invention, and a refrigeration unit including the sealed compressor are able to improve the suction efficiency of a suction muffler and the efficiency of the compressor, and therefore are widely applicable to refrigeration units in show cases, vending machines, etc., for business purposes, as well as electric refrigerators, air conditioners, etc., for household uses.

REFERENCE SIGNS LIST

1 sealed container
3 lubricating oil
5 refrigerant gas
7 compressor body
9 suspension spring
11 electric component
13 compression component
15 stator
17 rotor
19 cylinder
21 cylinder block
23 piston
25 valve plate
27 cylinder head
29 suction muffler
31 eccentric shaft
33 main shaft
35 crankshaft
37 joining means
39 bearing unit
41*a* discharge hole
43 compression chamber
100 sealed compressor
101 sealed container
102 compressor body
103 discharge pipe
104 suction pipe
105 lubricating oil
106 suspension spring
107 stator
108 opening
109 rotor
110 oil feeding mechanism
111 electric component
113 compression component
115 refrigerant gas
117 cylinder block
118 suction hole
119 compression chamber
120 head bolt
121 cylinder
123 bearing unit
125 valve plate
127 cylinder head
131 suction muffler
133 suction valve
135 crankshaft
137 main shaft
139 eccentric shaft
141 piston
143 joining means
145 high-pressure pipe
146 discharge hole
147 muffler body
149 muffler cover
150 muffling space
151 suction port
153 inlet pipe
155 bent portion
157 outlet pipe
159 first space
163 second space
165 separating wall
165A main surface
165B connection section
165C rear end portion
165D front end portion
200 refrigeration unit
201 body
203 storage space
205 mechanical chamber
207 partition wall
209 refrigerant circuit
213 heat radiator
215 pressure-reducing unit
217 heat absorber unit

The invention claimed is:

1. A sealed compressor comprising:

an electric component comprising a rotor and a stator;

a compression component actuated by the electric component; and a sealed container which accommodates therein the electric component and the compression component, and stores lubricating oil therein;

wherein the compression component includes a crankshaft including a main shaft and an eccentric shaft; a cylinder block including a bearing unit supporting the main shaft of the crankshaft such that the main shaft is rotatable, and a cylinder defining a compression chamber; and a suction muffler through which a refrigerant gas flows from an interior of the sealed container to an interior of the compression chamber;

wherein a space is present between the suction muffler and the stator in a radial direction of the main shaft, and a separating wall is provided in the space between the suction muffler and the stator in such a manner that the separating wall extends in an axial direction of the main shaft;

wherein a first space is formed in a radial direction of the main shaft between the suction muffler and the separating wall and along an entire height of the separating wall; and wherein a second space is formed in a radial direction of the main shaft between the stator and the separating wall and along an entire height of the separating wall.

2. The sealed compressor according to claim 1, further comprising:

a suction pipe provided to penetrate a wall of the sealed container and configured to flow therethrough a refrigerant gas suctioned into the sealed container;

wherein the suction muffler is placed such that a suction port of the suction muffler is positioned in the vicinity of an outlet of the suction pipe; and wherein the separating wall covers a rear end portion of the suction muffler which is located on an upstream side in a flow direction of the refrigerant gas induced in an interior of the sealed container by rotation of the rotor.

3. The sealed compressor according to claim 1, wherein the separating wall covers a front end portion of the suction muffler.

4. The sealed compressor according to claim 1, wherein the separating wall covers at least a portion of a back surface of the suction muffler, from which portion projects a refrigerant passage within the suction muffler.

5. The sealed compressor according to claim 1, wherein the separating wall covers an entire of a back surface of the suction muffler.

6. The sealed compressor according to claim 1, wherein the separating wall is mounted to the suction muffler.

7. The sealed compressor according to claim 1, wherein the stator is fastened to the cylinder block, and the rotor is fastened to the crankshaft; and wherein the separating wall is mounted to an upper surface of the stator.

8. The sealed compressor according to claim 7, wherein the separating wall extends upward farther than an upper end of the stator.

9. The sealed compressor according to claim 1, wherein the stator has a salient-pole structure in which concentrated windings are wound around salient poles.

10. The sealed compressor according to claim 1, wherein the electric component is driven at one of a plurality of operating frequencies.

11. The sealed compressor according to claim 1, wherein the electric component is placed above the compression component.

12. A refrigeration unit comprising:

the sealed compressor according to claim 1.

* * * * *